US005298834A

United States Patent [19]

Oda et al.

[11] Patent Number: 5,298,834

[45] Date of Patent: Mar. 29, 1994

[54] DISPLAY DISCHARGE LAMP

[75] Inventors: Seiichiro Oda; Satoshi Watanabe; Junichi Ida; Mitsuhisa Shimada, all of Gyouda, Japan

[73] Assignee: Okaya Electric Industrial Co., Ltd., Tokyo, Japan

[21] Appl. No.: 784,987

[22] Filed: Oct. 30, 1991

[30] Foreign Application Priority Data

Oct. 30, 1990 [JP] Japan ..... 2-113742[U]
Feb. 8, 1991 [JP] Japan ..... 3-068441[U]

[51] Int. Cl.[5] ..... H01J 61/04

[52] U.S. Cl. ..... 313/622; 313/618; 313/619; 313/631; 313/632

[58] Field of Search ..... 313/622, 619, 631, 618, 313/632, 43

[56] References Cited

U.S. PATENT DOCUMENTS 1,879,159 9/1932 Foulke ..... 313/619
2,002,551 5/1935 Schmierer ..... 313/618

FOREIGN PATENT DOCUMENTS 0020960 2/1984 Japan ..... 313/618
0046647 2/1990 Japan ..... 313/618

*Primary Examiner*—Donald J. Yusko
*Assistant Examiner*—Ashok Patel
*Attorney, Agent, or Firm*—Thomas R. Morrison

[57] ABSTRACT

A first display discharge lamp has a transparent airtight container filled with a discharge gas; a positive electrode disposed in the airtight container and supported by a stem having an air tube therein; a negative electrode of an inverted configuration disposed in the transparent airtight container and surrounded by the positive electrode; a lead member integrally formed with the positive electrode, having a bent portion between a lower end of the negative electrode and the stem; and an insulating member disposed between the lower end of the negative electrode and the bent portion of the lead member. According to a second display discharge lamp, both a negative electrode and a positive electrode are of an inverted conical configuration. The former has at least an open upper end, while the latter has an open upper end and an open lower end. A lower end of the positive electrode is inserted in an interior of the negative electrode from the open upper end of the negative electrode. And, a lower/outer periphery of the positive electrode is, in a non-contact condition, opposed to an upper/inner periphery of the negative electrode.

5 Claims, 10 Drawing Sheets

DISPLAY DISCHARGE LAMP

BACKGROUND OF THE INVENTION

1. Field of the Invention

This invention relates to display discharge lamps, and particularly, a display discharge lamp, in which a negative electrode and a positive electrode are facing each other in a transparent airtight container filled with a discharge gas therein.

2. Description of the Prior Art

Conventionally, small-sized incandescent bulbs having tungsten filament coils have been used as a light source for traffic information displays on highways, flight schedules, time displays in an airport terminals, time displays on main streets or various advertisement displays. The incandescent bulbs have a high brightness, but consume a great amount of electric power and have a lower durability. To overcome such defects, in recent years the display discharge lamps have been used as the light source, because they are superior due to less power consumption and a longer life span.

FIG. 11 is a view of a conventional display discharge lamp, and FIG. 12 is an enlarged perspective view of a main part thereof. A discharge lamp 71 includes an inverted conical negative electrode 72 of which upper and lower ends are open and a wire-shaped positive electrode 73 inserted from the lower open end of negative electrode 72. Namely, positive electrode 73 is spaced from the edge of a lower end **72*b* of negative electrode 72, keeping a discharge gap. A lead 72*a* of negative electrode 72 and a lead 73*a* of positive electrode 73 are supported by a glass-made stem 74. Those components are all disposed in a glass-made airtight container 75** filled with a discharge gas.

When a certain voltage is applied between negative electrode 72 and positive electrode 73, a trigger discharge occurs between lower end **72*b* of negative electrode 72 and a part 73*b* surrounded by lower end 72*b*, thereby transferring into an inner surface of negative electrode 72 to form a main discharge. The main discharge is a glow discharge which produces a bright negative glow on the inner surface of negative electrode 72. The light produced by the negative glow is reflected on an inner surface of negative electrode 72, and then the reflected light is emitted more intensely by way of a light collecting lens 75*a***.

A central part of stem 74 is formed in an air tube **74*a* for exhausting an air in the airtight container 75 and introducing the discharge gas. Air tube 74*a* is positioned in the central part thereof in order to cut off a remainder thereof by a burner after filling the discharge gas, rotating a long-sized glass tube. Since it is necessary to dispose both leads 72*a* and 73*a* at left and right sides of stem 74 while bypassing air tube 74*a*, positive electrode lead 73*a* forms a crank-shaped bent portion 73*c* between lower end 72*b* of (of negative electrode 72) and an upper end of stem 74. Further, in order to generate the trigger discharge between lower end 72*b* of negative electrode 72 and part 73*b* surrounded by lower end 72*b*, a distance 1 therebetween is predetermined to be smaller than a distance m between lower end 72*b* and a bent portion 73*c* of positive electrode lead 73*a***.

However, for the discharge display lamp, it is difficult to set an accurate position relationship between negative electrode 72 and positive electrode 73. When distance 1 is larger than distance m, in which the electric intensity between the lower end **72*b* of negative electrode 72 and bent portion 73*c* of positive electrode lead 73*a* is intensified, thereby possible triggering a discharge.. As a result, the trigger discharge is transferred to the outer surface of negative electrode 72. Thus, the main discharge should occur on the inner surface of negative electrode 72, but it is obliged to occur on the outer surface of negative electrode 72**. It is a so-called back discharge, so that the discharge lamp cannot perform its proper function.

FIG. 13 shows a view of another conventional display discharge lamp 81 for display, and FIG. 14 is an enlarged section view taken on line A—A in FIG. 13. Discharge lamp 81 includes a glass-made airtight container 82, a negative electrode 83 of an inverted conical shape disposed in airtight container 82 and a positive electrode 84 of the same inverted conical configuration surrounding negative electrode 83. Positive electrode 84 is supported by and fixed with two leads 87, 87 mounted on a top surface 86 of a stem 85. Further, negative electrode 83 is mounted on top surface 86 of stem 85 so as to be supported by one lead 89 inserted into a cutaway portion 88 of positive electrode 84, keeping a slight gap 90 between an inner periphery **84*a* of positive electrode 84 and an outer periphery 83*d* of negative electrode 83**.

Lead 89 of negative electrode 83 and two leads 87, 87 of positive electrode 84 are, inside a base 91 under stem 85, connected to a first outer terminal 92 and a second outer terminal 93, respectively. Inner periphery **83*a* and an edge portion 83*b* of negative electrode 83 are coated by an emitting material to reduce a breakdown voltage. Further, a light collecting lens 94 is formed at an uppermost part of airtight container 82. Further, formed inside stem 85 is an air tube 95 for exhausting air in airtight container 82 and filling a discharge gas by way of an opening 95*a*. After that, air tube 95** is cut off by a burner.

When a certain voltage is applied between negative electrode 83 and positive electrode 84, a trigger discharge occurs between edge portion **83*b* of negative electrode 83 and an inner periphery 84*a* of positive electrode 84, and then transferred to inner periphery 83*a* of negative electrode 83 to form a main discharge which is a glow discharge. Then, a negative glow is generated by which an interior of negative electrode 83, particularly, a lower part thereof becomes brighter. The light produced by the negative glow is reflected on inner periphery 83*a* of negative electrode 83, and emitted forwardly from an upper opening 83*c* of negative electrode 83 and an upper opening 84*b* of positive electrode 84 through lens 94**.

The disadvantage however, is that when using display discharge lamp 81 for a long time, the emitting material coated on edge portion **83*b* of negative electrode 83 may be worn, thereby the breakdown voltage on edge portion 83*b* is intensified. As a result, the trigger discharge occurs between upper end 83*e* of negative electrode 83 and inner periphery 84*a* of positive electrode 84, but the trigger discharge cannot extend across edge portion 83*b*, so that it continues to be discharged exclusively between outer periphery 83*d* of negative electrode 83 and inner periphery 84*a* of positive electrode 84 without being transferred to inner periphery 83*a* of negative electrode 83**.

OBJECTS AND SUMMARY OF THE INVENTION

It is therefore a display discharge lamp which overcomes the drawbacks of the prior art and realizes an effective gas discharge.

Briefly stated, a first display discharge lamp according to this invention comprises a transparent airtight container filled with a discharge gas; a positive electrode disposed in the transparent airtight container and supported by a stem having an air tube therein; a negative electrode of an inverted conical configuration disposed in the transparent airtight container and surrounded by the positive electrode; a lead member integrally formed with the positive electrode, having a bent portion formed between a lower end of the negative electrode and the stem; and an insulating member disposed between the lower end of the negative electrode and the bent portion of the lead member.

Since the insulating member is disposed between the lower end of the negative electrode and the bent portion of the positive electrode lead, the electric intensity therebetween is weakened, thereby making it possible to prevent occurrence of a trigger discharge. Thus, a so-called back discharge is prevented. As a result, the trigger discharge occurs between the lower end of the negative electrode and the positive electrode, and then is transferred to an interior of the negative electrode to form a glow discharge, i.e. a main discharge.

Further, a second display discharge lamp according to this invention comprises a transparent airtight container filled with a discharge gas; a negative electrode of an inverted conical configuration disposed in the transparent airtight container, said negative electrode having at least an open upper end; a positive electrode of an inverted conical configuration disposed in the transparent airtight container, said positive electrode having an open upper end and an open lower end; a lower end of the positive electrode being inserted in an interior of the negative electrode from the open upper end of the negative electrode; and a lower outer periphery of the positive electrode being, in a non-contact condition, opposed to an upper inner periphery of the negative electrode.

When a certain voltage is applied between the negative electrode and the positive electrode, a trigger discharge occurs between the inner surface of the negative electrode and the outer surface of the positive electrode and is transferred to a lower part of the negative electrode to form a glow discharge which is a main discharge. The luminous flux produced by the glow discharge is reflected on the inner surface of the negative electrode, and then goes to a lower part of the inner surface of the positive electrode from a lower opening of the positive electrode. Then, it is again reflected on the inner surface of the positive electrode, and emitted from an upper open end of the positive electrode. Since the trigger discharge begins to occur on the inner surface of the negative electrode, it is possible to remove the disadvantage of the prior art, i.e. a so-called back discharge that is produced because the trigger discharge which occurs on the outer surface of the negative electrode cannot be transferred to the inner surface of the negative electrode. Preferably, a suitable insulating material is coated on the outer surface of the negative electrode. Alternatively, in addition to such coating of the insulating material, an insulating member may be disposed between the outer surface of the positive electrode and the outer surface of the negative electrode. Under such structure, it is certainly possible to prevent the trigger discharge between the outer surface of the positive electrode and the outer surface of the negative electrode. Accordingly, the back discharge is effectively prevented.

DETAILED DESCRIPTION OF THE PREFERRED EMBODIMENTS

The preferred embodiments of this invention will be described with reference to the accompanying drawings.

Figure 1:
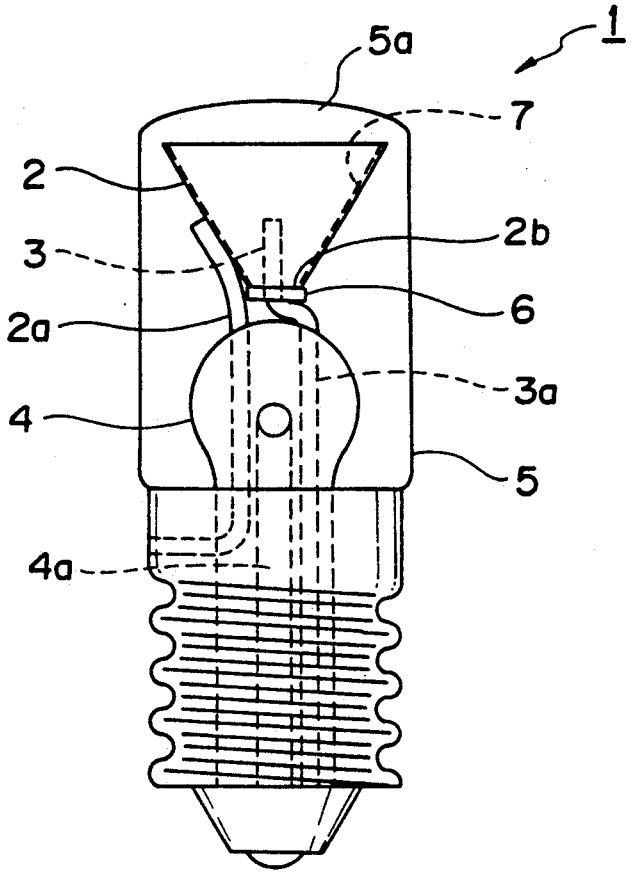
FIG. 1 is a side view of a first embodiment of a first display discharge lamp according to this invention.
Figure 2:
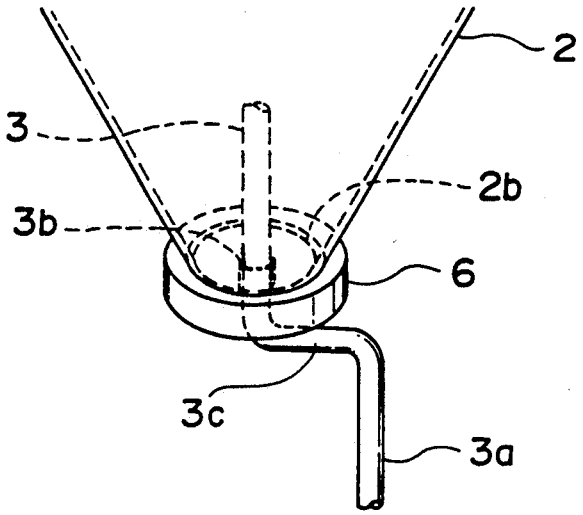
FIG. 2 is an enlarged perspective view of a main part of the first embodiment.

As illustrated in FIGS. 1 and 2, a first display discharge lamp comprises a negative electrode 2 of an inverted conical configuration, of which upper and lower ends are open, a wire-shaped positive electrode 3, a glass-made stem 4, a glass-made airtight container 5 and an insulating member 6. Negative electrode 2, positive electrode 3, stem 4 and insulating member 6 are all disposed in airtight container 5.

An emitting material 7 is coated on an inner surface of negative electrode to reduce a breakdown voltage. The emitting material consists of oxide containing an alkaline-earth metal element, oxide containing a rare earth element, or a single or composite boride containing a rare earth element. More specifically, it consists of BaO, $BaSrO_2$, $Y_2O_3$, $LaB_6$ or the like.

Positive electrode 3 is inserted into the interior of negative electrode 2 through a lower opening therein, and a lower part of negative electrode 2 may be spaced from positive electrode 3, keeping a discharge gap.

Negative electrode 2 is supported by and fixed with a lead **2*a* inserted into stem 4, while positive electrode 3 is integrally formed with a lead 3*a* inserted into stem 4. An air tube 4*a* is disposed at the center of stem 4, since it is convenient to cut off air tube 4*a* by a burner while rotating a long-sized glass-made tube when manufacturing it. Accordingly, two leads 2*a* and 3*a* are disposed along both left and right sides of air tube 4*a*, while penetrating into stem 4. Air tube 4*a* is effective to discharge air in airtight container 5** and fill thereinto a exhaust gas such as a rare gas for example, Ne, Ar or their mixture.

It is required to dispose negative electrode 2 at a central part of airtight container 5 and also dispose positive electrode 3 in an axial direction of airtight container 5, so that lead 3*a* of positive electrode 3 is integrally formed with a crank-shaped bent portion 3*c*.

Insulating member 6 made of e.g. a heatproof ceramic material is formed in a doughnut shape. Its diameter is larger than an outer diameter of lower end 2*b* of negative electrode 2. Lead 3*a* is inserted into insulating member 6 and positioned between bent portion 3*c* of lead 3*a* and lower end 2*b* of negative electrode 2.

When a certain voltage is applied between both electrodes 2 and 3 by way of both leads 2*a* and 3*a*, a trigger discharge occurs between lower end 2*b* of negative electrode 2 and a part 3*b* (on a periphery of positive electrode 3) surrounded by lower end 2*b* of negative electrode 2. It produces a glow discharge which is a main discharge to be transferred to the inner surface of negative electrode 2. Due to this glow discharge, the inner surface of negative electrode 2 produces a bright negative glow of which light is reflected on the inner surface of negative electrode 2, and the reflected light is emitted more intensively by way of a light collecting lens 5*a*.

Since a discharge path between lower end 2*b* of negative electrode 2 and bent portion 3*c* of lead 3*c* is shielded by insulating member 6, it prevents the trigger discharge from occurring therebetween, thereby enabling formation of the glow discharge on the inner surface of negative electrode 2. According to this embodiment, since the thickness of insulating member 6 can be formed substantially equal to the gap between lower end 2*b* of negative electrode 2 and bent portion 3*c* of lead 3*a*, it can be utilized as a jig for determining a position when assembling both electrodes 2 and 3.

Figure 3:
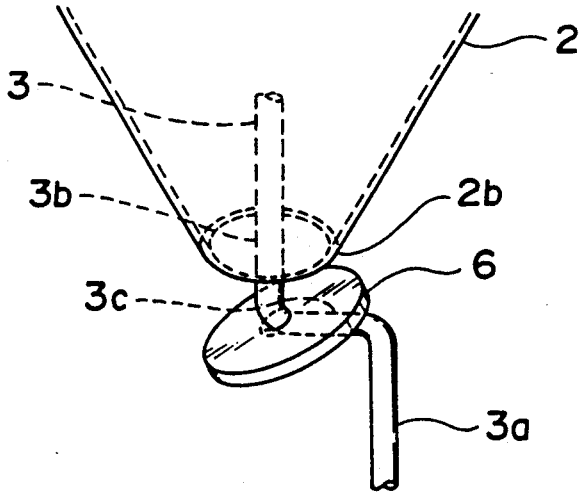
FIG. 3 is an enlarged perspective view of a main part of a further embodiment of the first display discharge lamp.

As illustrated in FIG. 3, the thickness of insulating member 6 is shorter than the gap between lower end 2*b* of negative electrode 2, but the diameter of the former can be larger than that of lower end 2*b*. In this way, it is possible to prevent the back discharge.

Preferably, the opening angle of negative electrode 2 is smaller, namely, from 20 to 90 degrees. Then, the negative glow is multiplied on the inner surface of negative electrode 2. It is a so-called hollow cathode effect, thereby the breakdown voltage and power consumption become lower and the luminance is higher.

A second display discharge lamp 10 according to this invention will be described with reference to the accompanying drawings.

Figure 4:
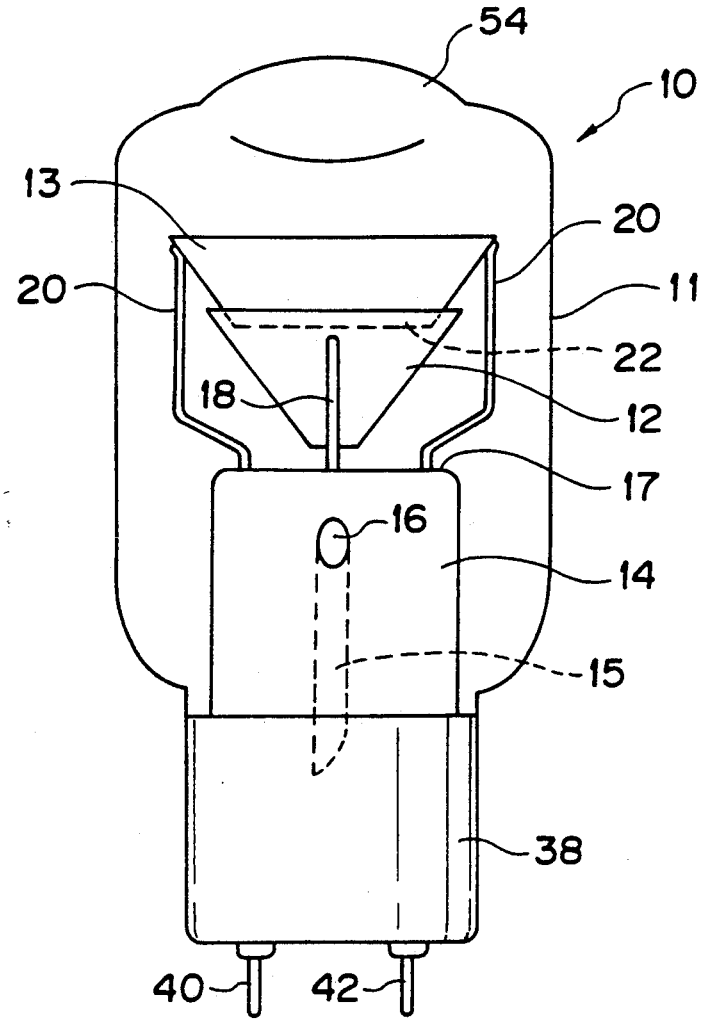
FIG. 4 is a side view of a first embodiment of a second display discharge lamp according to this invention.

FIG. 4 shows the whole of the second display discharge lamp 10 which comprises a glass-made airtight container 11, in which a negative electrode 12, a positive electrode 13 and a stem 14 are disposed. An air tube 15 is disposed at the central part of stem 14 to exhaust air therein through an air inlet 16 of air tube 15 and fill a discharge gas such as a rare gas, for example Ne, Ar or their mixture. After having filled the discharge gas, air tube 15 is cut off by a burner.

Figure 5:
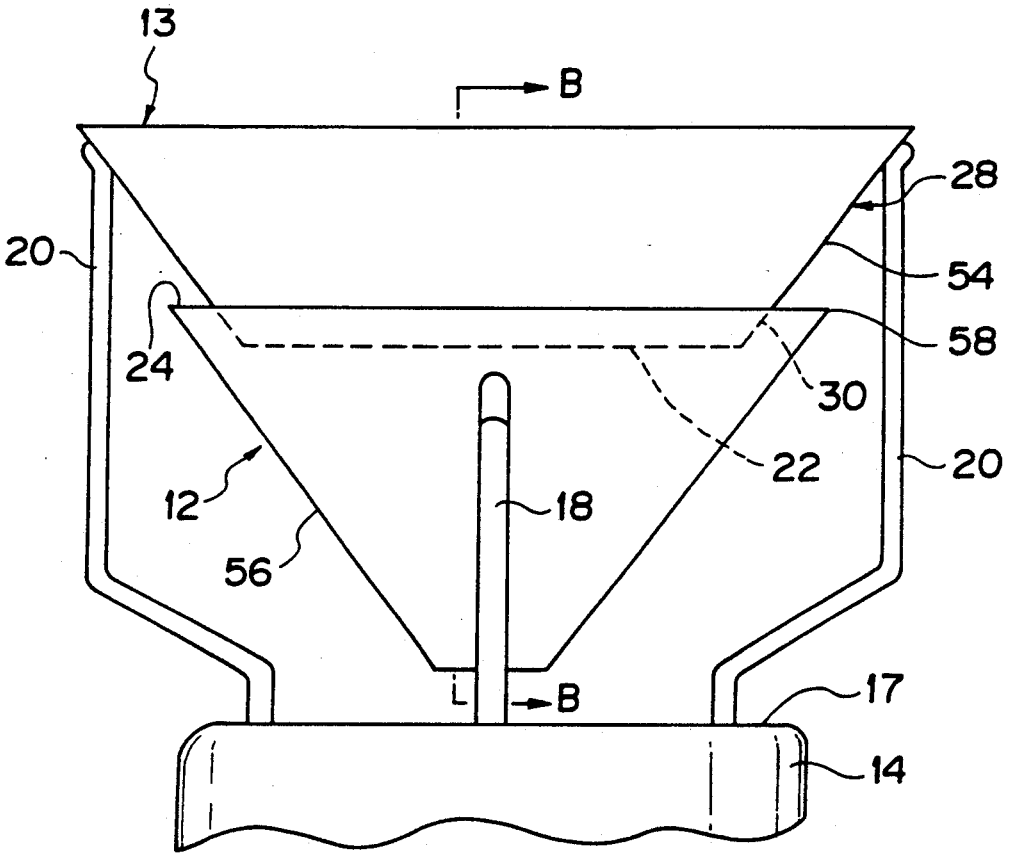
FIG. 5 is an enlarged view of a main part in FIG. 4.
Figure 6:
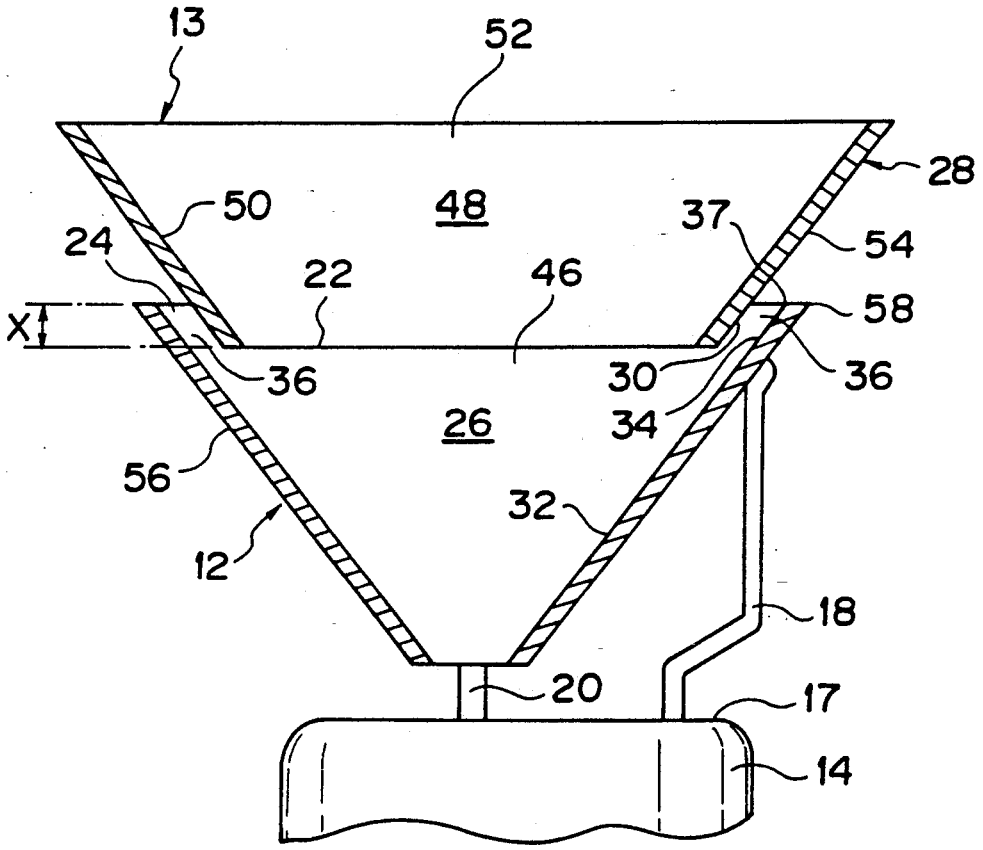
FIG. 6 is a section view taken along line B—B in FIG. 5.

FIG. 5 shows an enlarged view of a main part in FIG. 4 and FIG. 6 shows a section view taken along line B—B in FIG. 5. As illustrated in FIGS. 5 and 6, both electrodes 12 and 13 are of an inverted conical configuration, each of which has an upper lower opening. Negative electrode 12 is supported by and fixed with a lead 18 mounted on a top surface 17 of stem 14, while positive electrode 13 is supported by and fixed with two leads 20, 20 mounted on top surface 17 of stem 14, in order that a lower end 22 of positive electrode 13 is inserted into an interior 26 of negative electrode 12 from an upper opening 24 thereof. As a result, there is formed a gap 36 between an upper inner periphery 34 of negative electrode 13 and a lower outer periphery 30 of positive electrode 13.

An emitting material is coated on an inner surface 32 and an edge portion 37 of negative electrode 12 to reduce a breakdown voltage. The emitting material is made of oxide containing an alkaline earth metal element or a rare earth element or a single or composite boride containing a rare earth element. More specifically, it consists of BaO, $BaSrO_2$, $Y_2O_3$, $LaB_6$ or the like.

Lead 18 of negative electrode 12 and two leads 20, 20 of positive electrode 13 are respectively connected to a first outer terminal 40 and a second outer terminal 42 inside a base 38.

When a certain voltage is applied between both electrodes 12 and 13 by way of first and second outer terminals 40, 42, negative electrode lead 18 and positive electrode leads 20, 20, a trigger discharge occurs between edge portion 37 of negative electrode 12 and lower/outer periphery 30 of positive electrode 13. The trigger discharge is transferred to the inner surface 32 of negative electrode 12 to form a glow discharge which is a main discharge. Due to the glow discharge, there occurs a negative glow in interior 26 of negative electrode 12, thereby particularly a lower part of interior 26 becomes brighter. The light produced by the negative glow is reflected on inner surface 32 of negative electrode 12, the reflected light connects to an interior 48 of positive electrode 13 from lower opening 46 thereof, and then emitted, together with a light reflected on an inner surface 50 of positive electrode 13, from an upper opening 52 thereof. Subsequently, it is emitted more intensely by way of a light collecting lens 54 formed on a front end of airtight container 11.

As discussed previously, lower end 22 of positive electrode 13 is inserted in interior 26 of negative electrode 12. Accordingly, even though the emitting material coated on edge portion 37 of negative electrode 12 has been worn due to longtime use, the trigger discharge occurs between upper inner periphery 34 of negative electrode 12 and lower outer periphery 30 of positive electrode 13, and then is transferred to a lower part of interior 26 of negative electrode 12 to form the glow discharge which is the main discharge.

According to this embodiment, inner surface 32 of negative electrode 12 as well as inner surface 50 of positive electrode 13 can be used as a reflective surface. The opening angle of negative electrode 12 (an angle of a cone apex) has a significant influence on the discharge properties, so that it is restricted to some extent, but the opening angle of positive electrode 13 can be set at a user's own option. Accordingly, by enlarging the opening angle of positive electrode 13, it is easy to obtain a luminous flux superior to diffusion. Alternatively, by shortening its opening angle, it is also easy to obtain a luminous flux superior to directivity.

A height X of gap 36, namely an inserting degree of negative electrode 12 and positive electrode 13 is predetermined in view of the occurrence degree of the trigger discharge as well as in view of securing a glow discharge area on inner surface 32 of negative electrode 12.

Since lower end 22 of positive electrode 13 is inserted in interior 26 of negative electrode 12, the trigger discharge occurs between upper inner periphery 34 of negative electrode 12 and lower outer periphery 30 of positive electrode 13 even though the emitting material coated on edge portion 37 is wasted.

Accordingly, the trigger discharge is transferred to a lower part of interior 26 of negative electrode 12 to form the glow discharge which is the main discharge. Thus, a so-called back discharge is effectively prevented.

In case the emitting material adjacent upper inner periphery 34 of negative electrode 12 is wasted, the electric intensity between an upper outer periphery 54 of outer surface 28 of positive electrode 13 and upper end 58 of negative electrode 12 becomes stronger than the distance between lower outer periphery 30 and upper inner periphery 34, thereby there may occur the trigger discharge between upper outer periphery 54 and upper end 58. Further, the same thing may happen in case a distance between upper outer periphery 54 an upper end 58 is, due to a wider opening angle of positive electrode 13, shorter than that between lower outer periphery 30 and upper inner periphery 34. Further, in accordance with the configuration of positive electrode leads 20, 20, a distance between leads 20, 20 and upper end 58 of negative electrode 12 may be shorter than the distance between lower outer periphery 30 and upper inner periphery 34, thereby the trigger discharge may occur between leads 20, 20 and upper end 58. In this case, the trigger discharge cannot be transferred to interior 26 of negative electrode 12, thereby causing the back discharge.

To prevent such back discharge, e.g. a ceramic insulating material is preferably coated on upper outer periphery 54 of positive electrode 13, so that it is certain to prevent occurrence of the discharge between leads 20, 20 of positive electrode 13 and upper end 58 of negative electrode 12.

Figure 7:
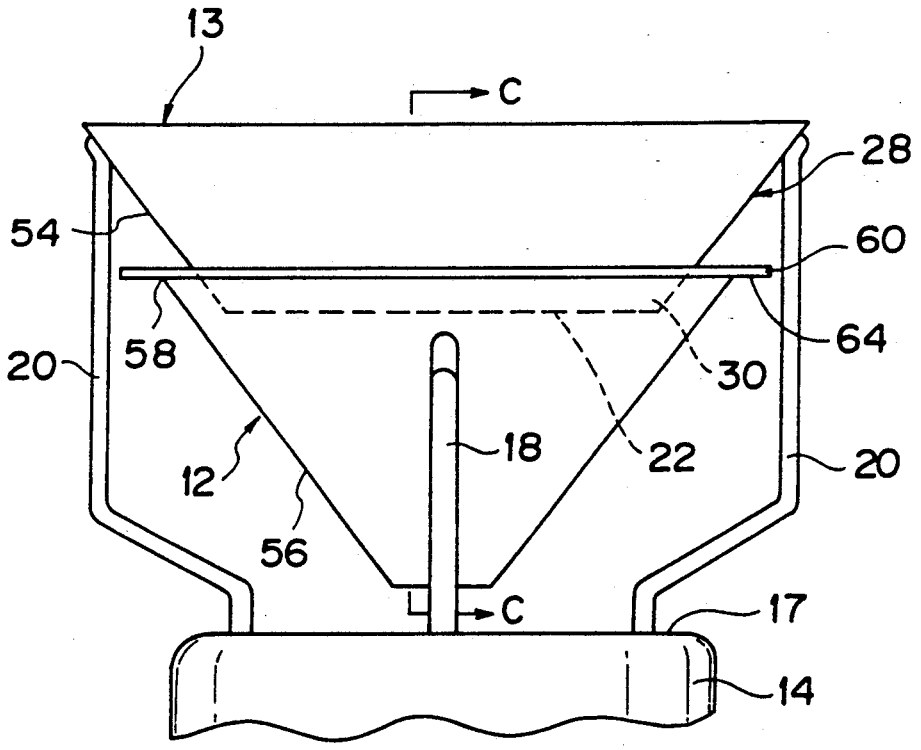
FIG. 7 is an enlarged view of a further embodiment of the second display discharge lamp.
Figure 8:
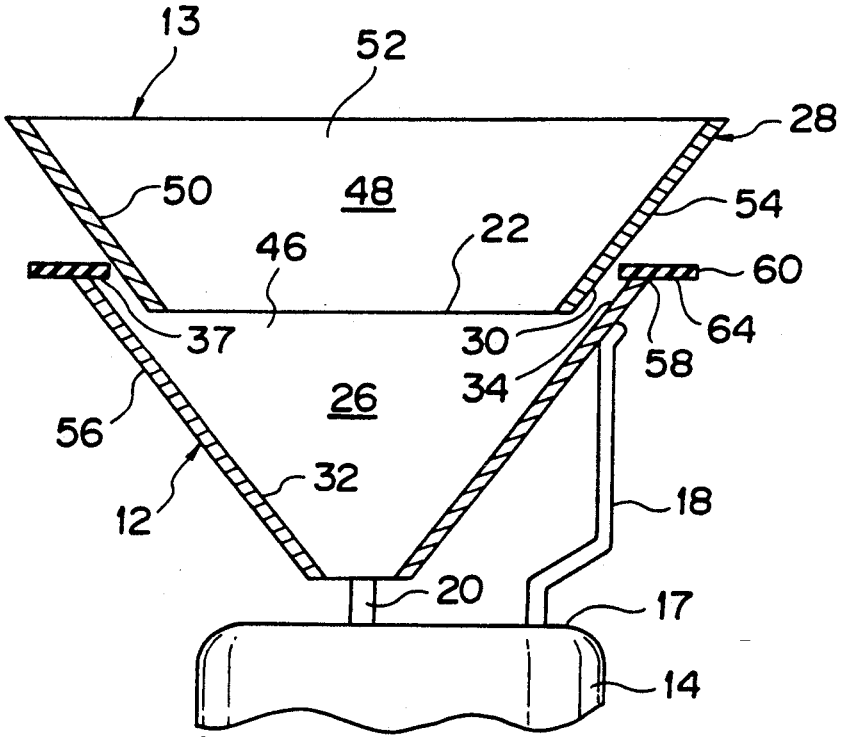
FIG. 8 is a section view taken along line C—C in FIG. 7.

An embodiment of a second display discharge lamp according to this invention will be discussed with reference to FIGS. 7 through 10. FIG. 7 shows an enlarged view of a main part of the foregoing embodiment, and FIG. 8 shows a section view of the main part thereof. As clearly illustrated in FIGS. 7 and 8, this embodiment is characterized in that an insulating annular plate 60 made of mica is disposed between upper end 58 of negative electrode 12 and upper outer periphery 54 of positive electrode 13. The other structure is identical with that of the foregoing embodiment.

Figure 9:
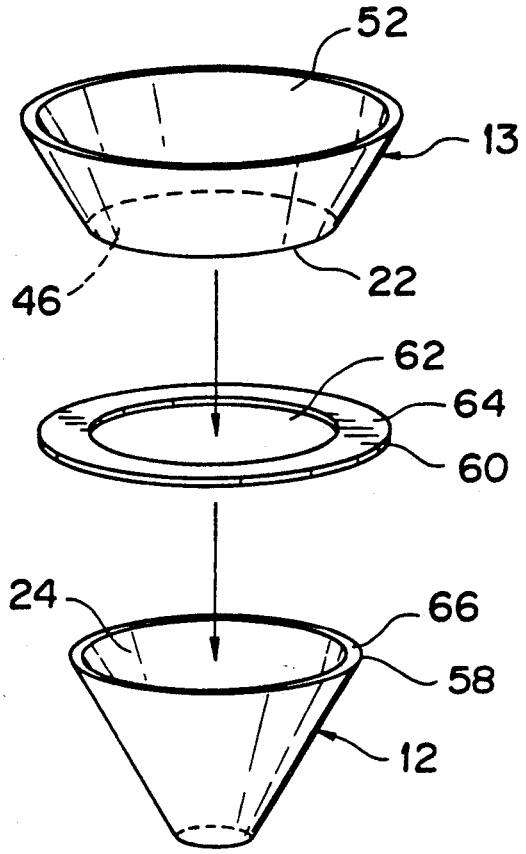
FIG. 9 is an exploded perspective view of the foregoing embodiment.
Figure 10:
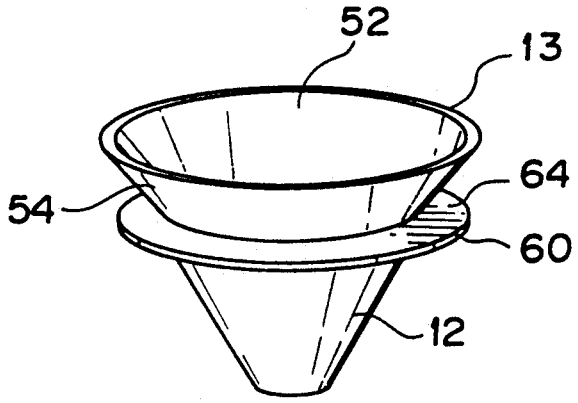
FIG. 10 is a perspective view of a main part of the foregoing embodiment.
Figure 11:
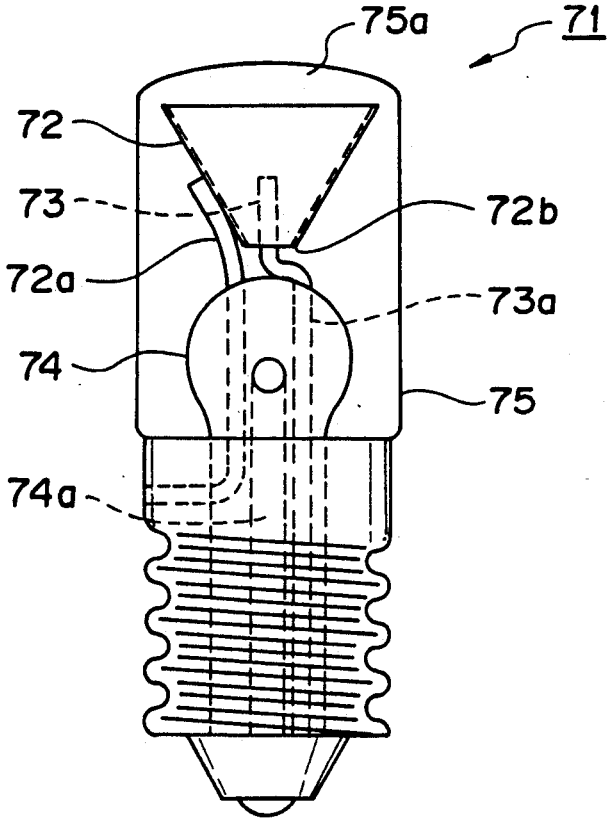
FIG.11 PRIOR ART
FIG. 11 is a side view of a first prior art.
Figure 12:
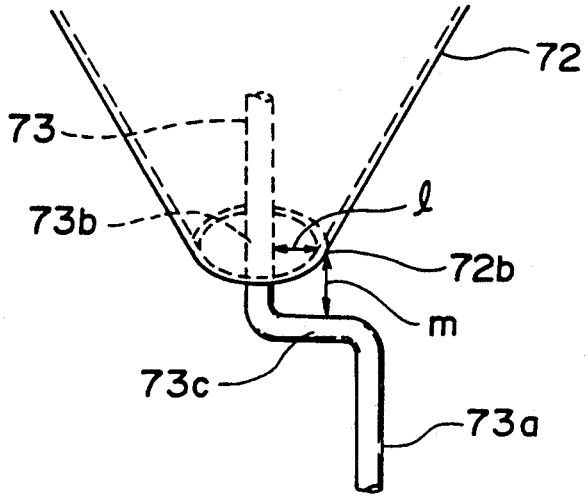
FIG.12 PRIOR ART
FIG. 12 is an enlarged perspective view of a main part of the first prior art.
Figure 13:
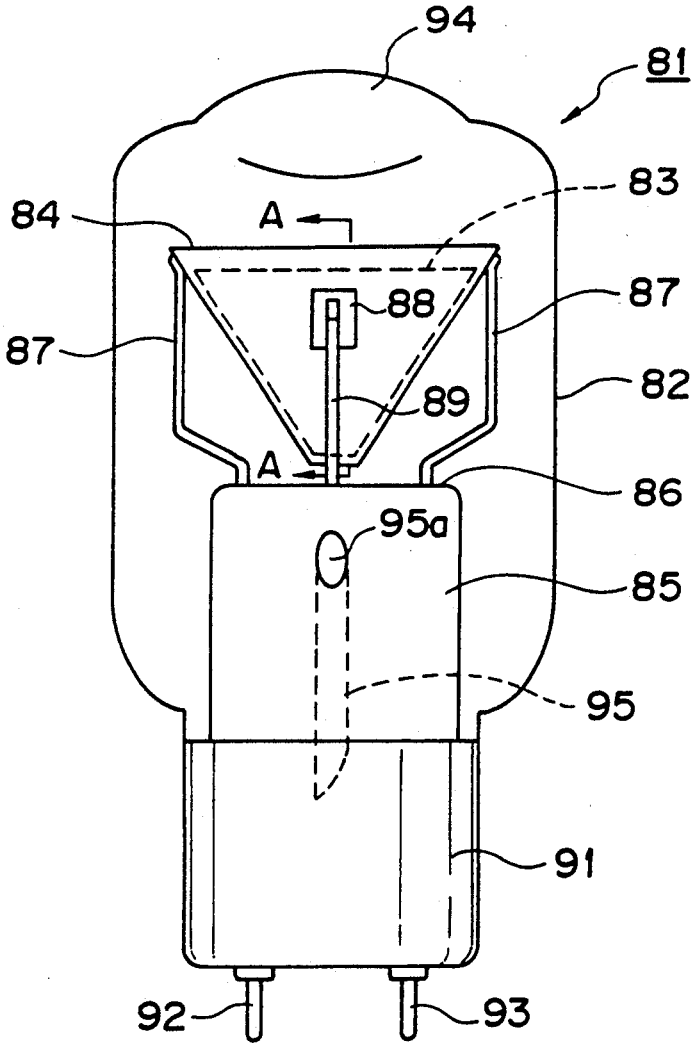
FIG. 13 PRIOR ART
FIG. 13 is a side view of a second prior art.
Figure 14:
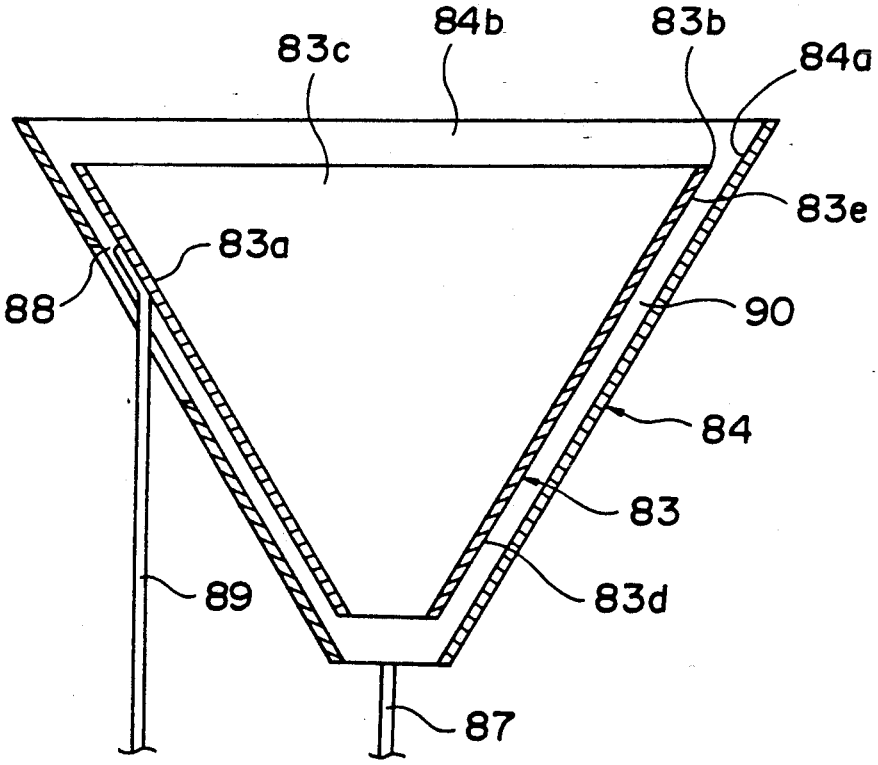
FIG. 14 PRIOR ART
FIG. 14 is an enlarged section view taken along line A—A in FIG. 13.

As illustrated in FIGS. 9 and 10, annular plate 60 has a larger opening 62, in which is inserted lower end 22 of positive electrode 13. Further, by mounting a flange 64 of annular plate 60 on top 66 of negative electrode 12, annular plate 60 can be disposed regularly between upper outer periphery 58 of negative electrode 12 and upper outer periphery of positive electrode 54. When a certain voltage is applied between both electrodes 12 and 13, the trigger discharge occurs between edge portion 37 and low outer periphery 30. Even though the emitting material of edge portion 37 has been worn, another trigger discharge occurs between upper inner periphery 34 and lower outer periphery 30, and is transferred to a lower part of inner surface 32 of negative electrode 12 to form the glow discharge. Accordingly, it is possible to prevent occurrence of the back discharge.

Since insulating plate 60 made of mica is disposed between upper outer periphery 58 and upper outer periphery 54, it is certainly possible to prevent occurrence of discharge therebetween.

Any suitable insulator made of, for example, a ceramic material may substitute mica-made insulating plate 60.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined on the appended claims.

What is claimed is:

1. A display discharge lamp comprising:
a transparent airtight container filled with a discharge gas;
a positive electrode disposed in said transparent airtight container and supported by a stem having an air tube therein;
a negative electrode of an inverted conical configuration disposed in said transparent airtight container and surrounding said positive electrode;
a lead member integrally formed with said positive electrode;
said lead member having a bent portion disposed between a base of said negative electrode and said stem; and
an insulating member disposed between said base of said negative electrode and said lead member, above said bent portion.

2. A display discharge lamp as defined in claim 1, wherein said positive electrode is wire shaped.

3. A display discharge lamp comprising:
a transparent airtight container filled with a discharge gas;
a negative electrode of an inverted conical configuration disposed in said transparent airtight container, said negative electrode having at least an open upper end;
a positive electrode of an inverted conical configuration disposed in said transparent airtight container, said positive electrode having an open upper end and an open lower end;
a lower end of said positive electrode being disposed in an interior of said negative electrode from said open upper end of said negative electrode; and
a lower outer periphery of said positive electrode and an upper inner periphery of said negative electrode being separated by a gap.

4. A display discharge lamp as defined in claim 3, in which an insulating material is coated on an outer surface of said negative electrode.

5. A display discharge lamp as defined in claim 3, in which an insulating member is disposed between said lower outer periphery of positive electrode and an upper inner periphery of said negative electrode.

* * * * *